US005802195A

United States Patent [19]

Regan et al.

[11] Patent Number: 5,802,195

[45] Date of Patent: Sep. 1, 1998

[54] HIGH DISPLACEMENT SOLID STATE FERROELECTRIC LOUDSPEAKER

[75] Inventors: Curtis R. Regan, Norfolk; Antony Jalink, Jr., Newport News; Richard F. Hellbaum, Hampton; Wayne W. Rohrbach, Yorktown, all of Va.

[73] Assignee: The United States of America as represented by the Administrator of the National Aeronautics and Space Administration, Washington, D.C.

[21] Appl. No.: 782,851

[22] Filed: Jan. 13, 1997

Related U.S. Application Data

[63] Continuation-in-part of Ser. No. 326,804, Oct. 11, 1994, abandoned.

[51] Int. Cl.[6] ..... H04R 25/00

[52] U.S. Cl. ..... 381/190; 381/173; 381/191; 310/324

[58] Field of Search ..... 381/190, 173, 381/191; 310/222, 234, 322, 324, 311, 358, 330, 331, 371, 363

[56] References Cited

U.S. PATENT DOCUMENTS

| | | | |
|---|---|---|---|
| 3,496,617 | 2/1970 | Cook et al. . | |
| 3,676,722 | 7/1972 | Schaff | 381/190 X |
| 3,816,774 | 6/1974 | Ohnuki et al. | 310/800 |
| 3,891,871 | 6/1975 | Henriquez et al. . | |
| 3,900,748 | 8/1975 | Adler | 310/9.6 |
| 4,373,119 | 2/1983 | Feder | 381/190 |
| 4,430,529 | 2/1984 | Nakagawa et al. | 381/190 |
| 4,488,010 | 12/1984 | Klein et al. | 179/110 A |
| 4,845,776 | 7/1989 | Bittencourt | 381/190 |
| 4,868,445 | 9/1989 | Wand . | |
| 4,979,219 | 12/1990 | Lin | 381/190 |
| 4,996,713 | 2/1991 | Bittencourt | 381/190 |
| 5,042,492 | 8/1991 | Dubut . | |
| 5,115,472 | 5/1992 | Park et al. | 381/152 X |
| 5,149,197 | 9/1992 | Rokos et al. . | |
| 5,185,549 | 2/1993 | Sullivan | 310/334 |
| 5,276,657 | 1/1994 | Newnham et al. | 367/157 |
| 5,291,460 | 3/1994 | Harada et al. | 381/190 |
| 5,309,519 | 5/1994 | Park et al. | 381/190 |
| 5,589,725 | 12/1996 | Haertling | 310/358 |
| 5,632,841 | 5/1997 | Hellbaum et al. | 156/245 |

OTHER PUBLICATIONS

Rainbows offer up to ten times the strain and 100 times the load capacity of conventional piezoelectric bimorphs. *Brochure by Aura Ceramics, Inc., New Hope, MN 55428.*

Rainbow—Handling instructions and Operation. Aura Ceramics, Inc. Oct. 13, 1993.

*Primary Examiner*—Curtis A. Kuntz
*Assistant Examiner*—Rexford N. Barnie
*Attorney, Agent, or Firm*—Robin W. Edwards

[57] ABSTRACT

A piezoelectric loudspeaker suitable for midrange frequencies uses a dome shaped piezoelectric actuator to drive a speaker membrane directly. The dome shaped actuator is made from a reduced and internally biased oxygen wafer, and generates excursion of the apex of the dome in the order of 0.02–0.05 inches when a rated drive voltage of 350 V rms is applied between the convex and the concave surfaces of the dome shaped actuator. The load capacity exceeds 10 lbs. The edge of the rim of the dome shaped actuator must be free to rock when the dome height varies to ensure low distortion in the loudspeaker. This is achieved by mounting the rim of the dome shaped actuator on a support surface by prestress only. An exceptionally simple design uses a planar speaker membrane with the center part of one side pressed against the rim of a dome shaped actuator by prestress from a stretched latex surround member.

13 Claims, 2 Drawing Sheets

HIGH DISPLACEMENT SOLID STATE FERROELECTRIC LOUDSPEAKER

This is a continuation-in-part of application(s) Ser. No. 08/326,804 filed on Oct. 11, 1994, now abandoned

ORIGIN OF THE INVENTION

The invention described herein was made in the performance of work done by employees of the U.S. Government and may be manufactured and used by or for the government for governmental purposes without the payment of any royalties thereon or therefore.

BACKGROUND OF THE INVENTION

1. Field of the Invention

The present invention relates to loudspeakers for sound reproduction, and more particularly to loudspeakers utilizing piezoelectric actuators to drive a speaker membrane.

2. Description of the Related Art

A loudspeaker system for sound reproduction typically consists of a cabinet with one or more loudspeakers ("drivers") covering separate parts of the desired frequency range. Typically there will be a high frequency driver ("tweeter"), a midrange driver, and a bass driver ("woofer"). The drivers are usually direct drivers, which have a speaker membrane coupled directly to the air for radiation to the listening area. Horn drivers, which have acoustic horns connected between the driven membrane and the free air to improve the coupling efficiency, are used mostly for high power public address applications. In either type of driver, the speaker membrane is moved back and forth in response to an electric voltage from an amplifier by means of an actuator, which can be either electromagnetic, electrostatic, or piezoelectric.

An electromagnetic loudspeaker uses a cylindrical voice coil of metal wire suspended in a radial magnetic field as an actuator. The voice coil is connected electrically to the amplifier output and mechanically to the speaker membrane, which moves in response to the axial force generated by the current flowing in the voice coil wire. The speaker membrane is usually a cone or small dome of thin walled material. Electromagnetic loudspeakers are today the dominant type of drivers.

An electrostatic loudspeaker uses a thin metallized film suspended in an electrostatic field as both actuator and speaker membrane. The metallized film is suspended between two acoustically open wire mesh screens. A high voltage electrostatic field is set up between the two mesh screens, and an alternating voltage derived from the amplifier output is impressed on the metallized film, which makes the film/membrane move back and forth in the electrostatic field to generate sound waves. The force per unit area of the membrane is small, so the membrane must be large to provide substantial sound pressure levels. Electrostatic loudspeakers are expensive.

A piezoelectric loudspeaker uses a piezoelectric actuator to drive the speaker membrane. A conventional piezoelectric actuator has very small maximum excursions, so piezoelectric drivers have been limited to use in earphones and high frequency horn speakers.

U.S. Pat. No. 3,900,748 to Adler describes a coiled element of ferroelectric material for use as a piezoelectric actuator for driving a speaker membrane. Large axial excursions of the coil ends are possible by arranging electrode pairs to set up shear stresses in the material so the element will twist along its center line when an electric potential difference is imposed between the electrode pairs. The element may be coiled either helically or spirally. In either case, the moving end of the material is coupled mechanically to a cone shaped membrane. Adler states that the described piezoelectric actuator has high compliance. This means that the force exerted on the speaker cone will be low, and that the moving end of the coil will require centering and guiding. The coiled piezoelectric elements are complicated and expensive to manufacture.

SUMMARY OF THE INVENTION

It is an object of the present invention to provide a piezoelectric loudspeaker suitable for use as a direct coupled midrange driver.

It is a further object of the invention to provide a midrange driver of simple and rugged design using a dome shaped actuator of piezoelectric material.

It is a still further object of the present invention to provide a direct coupled loudspeaker utilizing a dome shaped piezoelectric actuator that has low distortion.

These and other objects are accomplished by a loudspeaker comprising a speaker membrane; a speaker frame; a dome shaped actuator made from a reduced and internally biased oxide wafer of piezoelectric ceramic material, and which has a dome height that varies with a voltage applied between the outside and inside surfaces of the dome shaped actuator; and means for mounting the actuator between the speaker membrane and the speaker frame so an axial distance between the speaker membrane and the frame is determined by the dome height of the actuator. A preferred embodiment allows the edge of the rim of the dome shaped actuator to rock on a support surface when the dome height changes.

BRIEF DESCRIPTION OF THE DRAWINGS

The present invention and the objects achieved by it will be understood from the description herein, with reference to the accompanying drawings, in which.

DETAILED DESCRIPTION OF THE PREFERRED EMBODIMENTS

Figure 1:
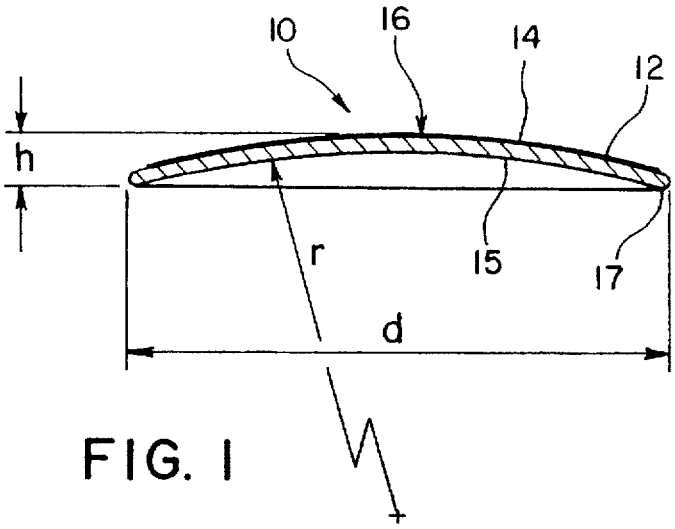
FIG. 1 is an axial sectional view through a piezoelectric actuator for a loudspeaker according to a preferred embodiment of the invention.

FIG. 1 is an axial sectional view through a piezoelectric actuator 10 made from a reduced and internally biased oxide wafer 12, as shown in U.S. Pat. No. 5,471,721 and commonly available from Aura Ceramics. The actuator 10 is dome shaped and is made from a flat wafer of a piezoelectric ceramic material, such as lead-lanthanide-zirconium-titanate (PLZT), by reducing one surface 15 while the other surface 14 is protected from the reducing medium. The reduced surface shrinks, so internal strains are set up in the wafer 12, and the wafer 12 takes on a shallow dome shape as illustrated in FIG. 1. The curvature (r) and the height (h) from rim 17 to apex 16 of the domed actuator 10 are exaggerated in FIG. 1 to be readily visible in the drawing. Actuators 10 are available with a diameter (d) from 0.5" to 4" and wafer thickness from 0.006" to 0.060".

The concave inner surface 15 of the actuator 10 is reduced to a conductive form of lead oxide, so it can directly serve as an electrode in the actuator 10. A conducting film 14 is applied to the convex outer surface of the actuator 10 to serve as a second electrode. The conducting film can be a metallic film deposited by sputtering, a conductive paint, or any other conductive film known in the art.

When an electric voltage is applied between the electrodes 14 and 15, a piezoelectric strain is generated in the wafer 12. This causes the radius of curvature (r) of the actuator 10 and the corresponding height (h) from rim 17 to apex 16 to change. The change in height (h) is typically about±0.02" in a 1.5" diameter actuator 10 for a voltage variation of ± 500 V.

The excursion provided by this type of dome shaped actuator 10 is about 100 times larger than the maximum excursions generated by conventional direct extending piezoelectric actuators, and about 10 times the excursion of bimorph piezoelectric actuators. The typical load capacity of the dome shaped actuator 10 is about 10 lbs., which is the about the same as the load capacity of direct extender piezoelectric actuators, but more than 100 times the load capacity of bimorphs. Large excursion combined with large load capacity makes the domed piezoelectric actuator 10 suitable for driving speaker membranes in loudspeakers for midrange frequencies.

Figure 2:
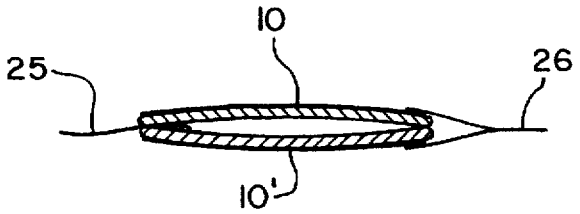
FIG. 2 is an axial sectional view through a pair of piezoelectric actuators as shown in FIG. 1 stacked rim against rim in clamshell fashion according to a preferred embodiment of the invention.

Twice as large excursions can be obtained from a pair of dome shaped actuators 10, 10' stacked rim against rim in clamshell fashion, as shown in FIG. 2. A strip of metal foil 25 inserted between the rims of the two actuators 10, 10' contacts the inner surface electrodes 15 of both actuators 10 and 10', and another strip of metal foil 26 interconnects the two external electrodes 14. When a voltage is applied between the metal foil strips 25 and 26, both actuators 10 and 10' change their heights (h) in the same direction. Several such clamshell assemblies can be cascaded if still larger excursions are needed. Any internally prestressed dome shaped ferroelectric actuator can be used; for instance, the actuator shown in "Thin Layer Composite Unimorph Ferroelectric Driver and Sensor", Ser. No. 08/416,598, filed Apr. 4, 1995, can also be used.

Figure 3:
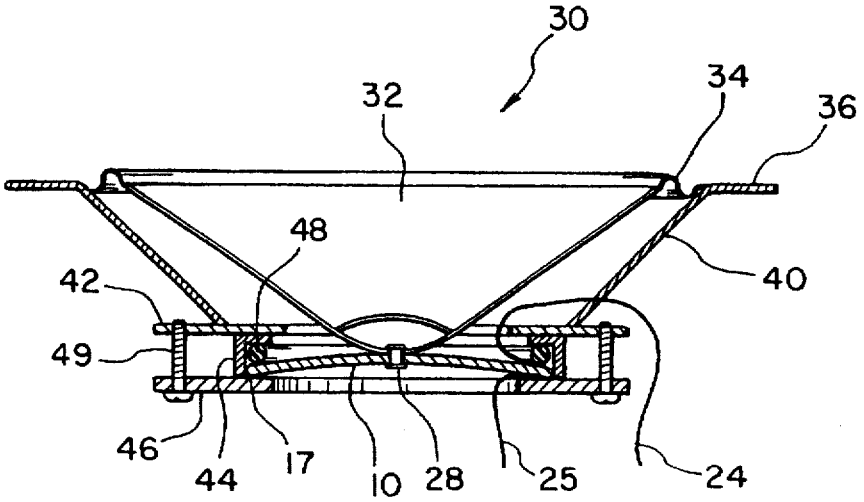
FIG. 3 is an axial sectional view through a midrange driver according to a preferred embodiment of the invention.

A first preferred embodiment of the invention is illustrated in FIG. 3, which is an axial sectional view through a loudspeaker 30 using a dome shaped piezoelectric actuator 10 to directly drive a speaker membrane in the form of a conventional speaker cone 32. The speaker cone 32 is mounted, as is common in the art, to a mounting flange 36 via a surround member 34 of rubber. The mounting flange 36 is part of a conventional speaker basket 40 with a flange 42 for support of the actuator 10 driving the speaker cone 32. The surround member 34 is weak axially, but sufficiently rigid in the lateral plane to keep the speaker cone 32 centered. When the loudspeaker 30 is mounted on the wall of a loudspeaker cabinet, the surround member 34 also seals the cabinet so out of phase sound pressure from the rear of the loudspeaker cone 32 does not interfere with the sound waves radiated from the front of the speaker cone 32.

The narrow end of the speaker cone 32 is closed by a semi-spherical bottom end. The apex of a dome shaped piezoelectric actuator 10 as shown in FIG. 1 is mechanically connected to the bottom end of the speaker cone 32 by a screw or a rivet 28 passing through holes in the actuator 10 and the bottom end of the speaker cone 32. Insulation must be provided to avoid short circuiting the outer electrode 14 and inner electrode 15 of the dome shaped actuator 10, e.g., by using a plastic fastener for connecting the apex of the actuator 10 to the speaker cone 32.

The rim 17 of the actuator 10 is mounted to the flange 42 via a mounting plate 46 of insulating material and an O-ring 48 of soft elastomeric material. The mounting plate 46 is fastened to the flange 42 by screws 49, and a spacer ring 44 is inserted between the mounting plate 46 and the flange 42 to maintain a predetermined pressure by the O-ring 48 on the rim of the actuator 10. The pressure from the O-ring 48 provides a prestress force of 4 to 8 oz between the rim 17 of the actuator 10 and the mounting plate 46. The O-ring pressure on the actuator 10 thus prestesses the entire actuator 10, thereby mechanically biasing the actuator 10 and the speaker cone 32. By applying a fixed amount of mechanical bias or prestress to the actuator 10 and mounting the actuator 10 such that its motion as it becomes more flat or more curved with applied voltage adds or subtracts a varying amount of mechanical bias from the initial bias, the speaker is more responsive at lower voltage levels. Strips 24 and 25 of metal foil are applied to the outside and inside electrodes 14, 15 of the actuator 10 to serve as leads for the drive voltage. An alternating voltage applied between metal strips 24 and 25, will cause the height (h) from the rim 17 to the apex 16 of the actuator 10 to alternate with the voltage.

When the polarity of the drive voltage is such that the height (h) increases, the apex 16 of the actuator 10 will push the speaker cone 32 outward, away from the mounting plate 46, so the sound pressure in front of the speaker cone 32 increases. The force exerted by the apex 16 of the actuator 10 will cause a reaction force between the rim 17 and the fixed mounting plate 46, which adds to the prestress force from the O-ring 48.

When the drive voltage has the opposite polarity, the apex 16 of the actuator 10 will pull the speaker cone inward, thereby reducing the sound pressure in front of the speaker cone 32. At the same time, the rim 17 of the actuator 10 will be pulled away from the mounting plate 46. As long as the prestress force exerted by the O-ring 48 is larger than the maximum pulling force on the actuator 10, the rim 17 of the actuator 10 will remain pressed against the mounting plate 48, and the actuator 10 will behave as if it were firmly attached to the mounting plate 46. The limited pressure from the O-ring 48, however, does allow the edge of the rim 17 on the dome shaped actuator 10 to rock on the mounting plate 46 when the radius of curvature (r) of the actuator 10 changes in response to the drive voltage.

One way to mount the rim 17 of the actuator 10 on the mounting plate 46 would be by soldering or gluing. This would allow for much larger negative forces on the apex 16 of the actuator 10, but the rim 17 would then be locked in place, so it could not rock on its edge when the radius of curvature (r) of the actuator 10 changes in response to the drive voltage. The actuator 10, accordingly, would not be able to maintain a true spherical curvature when its height apex (h) varies. This introduces spurious strains in the actuator 10 and causes nonlinearities in the apex excursions (h).

Accordingly, as embodied herein, a main source of nonlinearity in the loudspeaker 30 is eliminated by mounting the rim 17 of the actuator on its contact surface by prestress only, so the edge of the rim 17 is free to rock when the apex height (h) changes.

The apex 16 of the dome shaped actuator 10 is laterally stable, so it can center the narrow end of the speaker cone 32 without need for a separate centering spider, which is required in electromagnetic loudspeakers.

Figure 4:
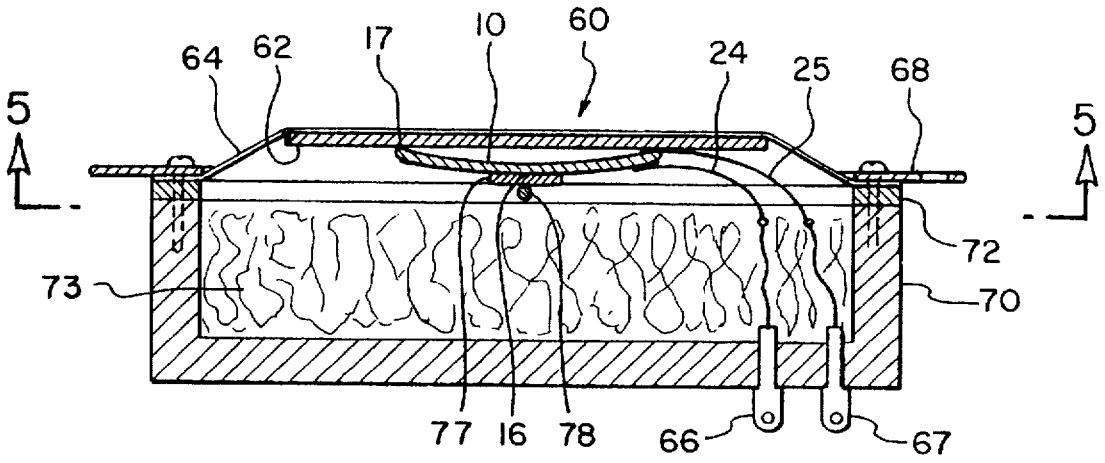
FIG. 4 is an axial sectional view through a midrange driver of planar design along line 4—4 as shown in FIG. 5 according to a preferred embodiment of the invention.
Figure 5:
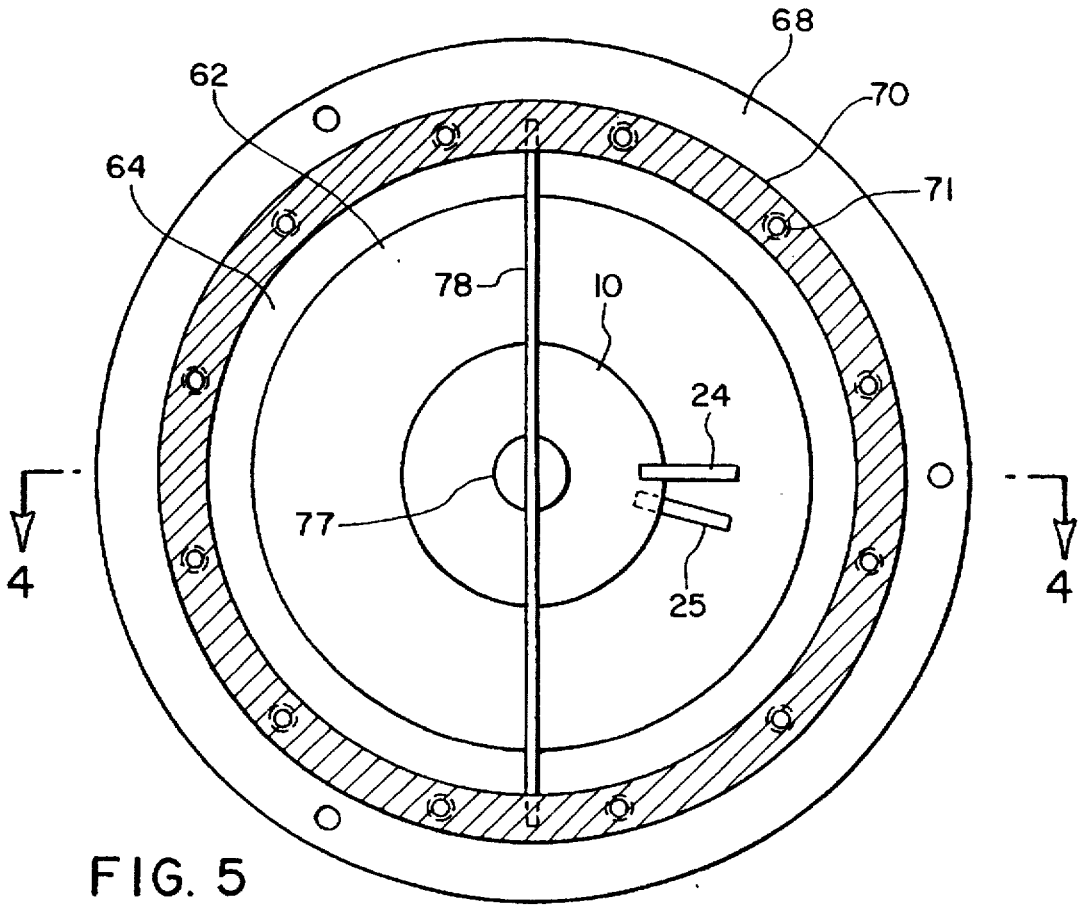
FIG. 5 is a view from the rear of the midrange driver shown in FIG. 4 taken along line 5—5 therein.

A second preferred embodiment of the invention is a planar midrange driver illustrated in FIGS. 4 and 5. FIG. 4 is an axial sectional view through a loudspeaker 60, and FIG. 5 is a rear view of the moving parts of the loudspeaker 60 taken along section line 5—5 in FIG. 4. The radiating element of the loudspeaker 60 is a 3" diameter planar disc membrane 62 made from 0.064" thick styrofoam. The styrofoam disc membrane 62 is supported by the rim 17 of a dome shaped actuator 10. The apex 16 of the actuator 10 is supported by a frame member 78 in the form of a 0.092" thick steel wire via a rubber disc 77. The speaker membrane 62 is prestressed against the rim 17 of the actuator 10 and the frame member 78 by means of a 0.0005–0.001" thick latex film 64 serving as a surround.

The loudspeaker 60 is assembled by first stretching the latex film 64 flat on a mounting plate 72, and then clamping the rim of the film 64 between the mounting plate 72 and a mounting flange 68 by screws 71. The membrane 62 and the actuator 10 with contact strips 24, 25 attached are next centered on the inside of the flat latex film 64, the rubber disc 77 is placed on the apex 16 of the actuator 10, and the frame wire 78 is pressed against the actuator 10 until its ends fit in cut-outs in the mounting ring 72. The thickness of the mounting plate 72 is designed to provide sufficient stretching of the latex film 64 to provide a prestress force of 4 to 8 oz between the rim 17 of the actuator 10 and the membrane 62 on one side and apex 16 of the actuator 10 and the frame wire 78 on the other side.

The mounting plate 72 is finally mounted on a closed driver box 70 by means of screws 71, so the frame wire 78 is clamped in place in its cutout. The driver box 70 is lightly filled with acoustic damping material 73, such as glass fiber insulation or acoustic foam, as is common in the art. Connectors 66, 67 for the drive voltage are provided in the bottom of the box 70.

An increase in apex height (h) of the actuator 10 caused by a drive voltage between terminals 66, 67 forces the membrane 62 outward against tension in the latex film 64. A decrease in the apex height (h) makes the latex film 64 pull the membrane 62 inward to remain in contact with the retreating rim 17 of the actuator 10. In either case, the movement of the membrane 62 is determined by the apex height (h) of the actuator 10. The inward movement of the membrane 62 follows a decrease in apex height (h) in the actuator 10 only as long as the axial pull from the latex film 64 is larger than the outward force on the membrane 62 from the reduced sound pressure and acceleration forces. For a midrange driver 60, the sum of such forces are lower than the initial 4 oz prestress force, so there is no risk that the actuator 10 will lose its mechanical contact with the speaker membrane 62 or the frame wire 78.

The loudspeaker 60 functions the same way as the loudspeaker 30 described earlier with reference to FIG. 3. In both cases, the rim 17 of the dome shaped actuator 10 is free to rock and expand on its support surface, so nonlinearities are minimized. In the planar loudspeaker 60 (FIGS. 4–5), the prestress force holding the rim 17 of the actuator 10 in place on its contact surface, however, is applied across the actuator 10, which is sandwiched between the speaker membrane 62 and the speaker frame comprising box 70 and frame wire 78. The source of the prestress force in this case, therefore, should be able to accommodate the full excursions of the apex 16 of the dome shaped actuator 10 without excessive changes in the prestress force. This is accomplished by the relatively wide and thin latex film used as the surround member in loudspeaker 60. The source of the prestress in loudspeaker 30 (FIG. 3) needs only accommodate the slight rocking motion of the edge of the rim 17 of the actuator 10, so a relatively rigid O-ring 48 is a suitable means for prestressing the rim 17 of the actuator 10 against its support surface in that loudspeaker 30.

The planar loudspeaker 60 illustrated in FIGS. 4 and 5 is extremely simple in design and can be manufactured at very low cost. The rim 17 of the actuator 10 provides support for the planar speaker membrane 62 between the center and the periphery of the membrane 62, so a very thin and light membrane can be used.

Twice as large excursions as those obtained from the single dome shaped actuator 10 can be obtained by supporting the planar speaker membrane 62 by a pair of actuators connected at their apexes by a rivet or screw and providing a flat support surface for the rim of the second actuator on the frame wire 78.

The rated drive voltage for either of the piezoelectric speakers 30, 60 described above is about 350 V rms, while the rated output voltage from commercially available audio amplifiers is only about 20 V rms. The output voltage from an audio amplifier, however, can easily be converted to a higher voltage by a small transformer, which would be included as part of a crossover network regularly included in a loudspeaker system for deriving separate signals for tweeters, midrange drivers, and woofers. A loudspeaker according to the preferred embodiments of the invention thus can easily be incorporated in a loudspeaker system powered by a conventional audio amplifier.

A loudspeaker 30 or 60 as described above and illustrated in FIGS. 3–5 with excursion in the order of 0.020" and a speaker membrane with diameter 3"–3.5" generates sound pressures sufficient for a hi-fi system down to frequencies below 1,000 Hz. The described loudspeakers 30, 60 according to the above-described preferred embodiments of the invention thus can be used as midrange drivers. This was not possible with previously known piezoelectric loudspeakers, which had so small excursions that they could only generate sufficient sound pressure as tweeters.

The dome shaped actuator 10 has low compliance and large load capacity so it can drive a loudspeaker 30, 60 up to the highest audible frequencies. A loudspeaker 30, 60 could thus theoretically be used as a combined tweeter/midrange driver. The limiting factor would in practice be "beaming" at high frequencies, because the diameter of the speaker membrane is large compared to the sound wavelength at frequencies in the mid to upper kHz range. Beaming can to some extent be controlled by diffusers or acoustic lenses. The cost of a loudspeaker 30, 60 according to the embodiments of the invention, however, is so low that it may in most cases be more economical to build separate tweeters similar to the described midrange drivers 30, 60, but with small diameter domed speaker membranes for better dispersion at the highest frequencies.

Numerous modifications and adaptations of the present invention will be apparent to those skilled in the art. Thus, the following claims and their equivalents are intended to cover all such modifications and adaptations which fall within the true spirit and scope of the present invention.

What is claimed is:

1. A loudspeaker, comprising:

(a) a speaker membrane;

(b) a speaker frame;

(c) a solid state integral monomorph dome shaped internally prestressed ferroelectric actuator having a spherical curvature, said solid state integral monomorph dome shaped actuator having a rim and an apex, and a dome height measured from a plane through said rim to said apex that varies with an electric voltage applied between an inside and an outside surface of said dome shaped actuator; and (d) means for mounting said actuator between said speaker frame and said speaker membrane so that said dome height determines an axial distance between said speaker frame and said speaker membrane, wherein said actuator is sandwiched between said speaker membrane and said speaker frame and a predetermined prestress force is applied between said speaker membrane and said speaker frame for mechanically biasing said actuator and said speaker membrane so that the responsiveness of the loudspeaker to lower levels of voltage is increased.

2. A loudspeaker according to claim 1, wherein said means for mounting said actuator permits the edge of said rim pivot freely when said dome height varies so that the spherical curvature of the dome shape is maintained, thereby permitting maximum dome height excursions.

3. A loudspeaker according to claim 2, wherein said mounting means comprises prestress which permits the edge of the rim to pivot freely when said dome height varies.

4. A loudspeaker according to claim 2, wherein said speaker membrane is a planar membrane and said actuator is arranged with its rim in contact with one side of said planar membrane.

5. A midrange driver for a loudspeaker system, comprising:

(a) a speaker membrane;

(b) a speaker frame;

(c) a solid state integral monomorph dome shaped internally prestressed ferroelectric actuator having a spherical curvature for driving the speaker membrane, said actuator having a rim and an apex and an apex height that varies with an electric voltage applied between an inside and an outside surface of said dome shaped actuator;

(d) means for mounting said actuator between said speaker frame and said speaker membrane so that said apex height determines an axial distance between said speaker frame and said speaker membrane, wherein said actuator is sandwiched between said speaker membrane and said speaker frame and a predetermined prestress force is applied between said speaker membrane and said speaker frame for mechanically biasing said actuator and said speaker membrane so that the responsiveness of the loudspeaker to lower levels of voltage is increased and the spherical curvature of the actuator is maintained as the apex height varies.

6. A midrange driver for a loudspeaker system according to claim 5, wherein said speaker membrane is a planar disc of light weight material and said rim of said dome shaped actuator is pressed against the center of said planar disc by said predetermined prestress force.

7. A midrange driver according to claim 5, wherein said actuator has a lower cutoff frequency response below 1,000 Hz.

8. A device according to claim 1, wherein said actuator is made from a reduced and internally biased oxide wafer of piezoelectric material.

9. A device according to claim 5, wherein said actuator is made from a reduced and internally biased oxide wafer of piezoelectric material.

10. A device according to claim 1, wherein said actuator is made from a thin layer composite unimorph ferroelectric driver and sensor.

11. A device according to claim 5, wherein said actuator is made from a thin layer composite unimorph ferroelectric driver and sensor.

12. A loudspeaker, comprising:

(a) a speaker membrane;

(b) a speaker frame;

(c) a solid state integral monomorph dome shaped internally prestressed ferroelectric actuator having a spherical curvature, said solid state integral monomorph dome shaped actuator having a rim and an apex, and a dome height measured from a plane through said rim to said apex that varies with an electric voltage applied between an inside and an outside surface of said dome shaped actuator; and (d) means for mounting said actuator between said speaker frame and said speaker membrane so that said dome height determines an axial distance between said speaker frame and said speaker membrane, wherein said actuator is sandwiched between said speaker membrane and said speaker frame and a predetermined prestress force is applied between said speaker membrane and said speaker frame for mechanically biasing said actuator and said speaker membrane so that the responsiveness of the loudspeaker to all levels of voltage is increased.

13. A midrange driver for a loudspeaker system, comprising:

(a) a speaker membrane;

(b) a speaker frame;

(c) a solid state integral monomorph dome shaped internally prestressed ferroelectric actuator having a spherical curvature for driving the speaker membrane, said actuator having a rim and an apex and an apex height that varies with an electric voltage applied between an inside and an outside surface of said dome shaped actuator;

(d) means for mounting said actuator between said speaker frame and said speaker membrane so that said apex height determines an axial distance between said speaker frame and said speaker membrane, wherein said actuator is sandwiched between said speaker membrane and said speaker frame and a predetermined prestress force is applied between said speaker membrane and said speaker frame for mechanically biasing said actuator and said speaker membrane so that the responsiveness of the loudspeaker to all levels of voltage is increased and the spherical curvature of the actuator is maintained as the apex height varies.

* * * * *